US012203351B2

(12) United States Patent
Al-Otaibi et al.

(10) Patent No.: US 12,203,351 B2
(45) Date of Patent: Jan. 21, 2025

(54) HYDRAULIC SLIDING SLEEVE FOR ELECTRIC SUBMERSIBLE PUMP APPLICATIONS

(71) Applicant: SAUDI ARABIAN OIL COMPANY, Dhahran (SA)

(72) Inventors: Hazza G. Al-Otaibi, Khobar (SA); Jawad M. Al-Khalifah, Sayhat (SA); Ahmed M. Al-Otaibi, Dammam (SA); Thamer I. Al-Harbi, Alkhobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 2 days.

(21) Appl. No.: 18/153,809

(22) Filed: Jan. 12, 2023

(65) Prior Publication Data

US 2024/0240545 A1 Jul. 18, 2024

(51) Int. Cl.
*E21B 43/12* (2006.01)
*E21B 43/34* (2006.01)

(52) U.S. Cl.
CPC ..... *E21B 43/128* (2013.01); *E21B 43/34* (2013.01); *E21B 2200/06* (2020.05)

(58) Field of Classification Search
CPC ..... E21B 43/128; E21B 43/34; E21B 2200/06
See application file for complete search history.

(56) References Cited

U.S. PATENT DOCUMENTS 10,378,322 B2 8/2019 Ejim et al.
10,677,032 B1 * 6/2020 Norton ..... E21B 34/14
11,078,774 B2 8/2021 Gupta et al.
11,448,206 B2 9/2022 Armacanqui et al.
2007/0274849 A1 * 11/2007 Martinez ..... E21B 43/128 417/423.3
2008/0245525 A1 * 10/2008 Rivas ..... E21B 43/128 166/105.5
2012/0027630 A1 * 2/2012 Forsberg ..... E21B 47/008 73/24.06
2014/0262244 A1 * 9/2014 Gill ..... E21B 47/008 166/250.03
2018/0274344 A1 * 9/2018 Ejim ..... E21B 47/008
2019/0264518 A1 * 8/2019 Al-Gouhi ..... E21B 34/066
2020/0248541 A1 * 8/2020 Rabba ..... E21B 49/0875
2020/0325766 A1 * 10/2020 Gupta ..... E21B 47/008
2020/0370400 A1 * 11/2020 Guindi ..... E21B 47/008

* cited by examiner

*Primary Examiner* — George S Gray

(74) *Attorney, Agent, or Firm* — Vorys, Sater, Seymour and Pease LLP

(57) ABSTRACT

A method of producing a wellbore fluid from a wellbore includes operating an electric submersible pump (ESP) system in a wellbore to propel the wellbore fluid through a tubing string in the wellbore and determining that a gas pocket of free gas in an annulus around the tubing string that is accumulating and approaching an inlet of the ESP system. The gas pocket is roofed from above by a production packer. In response to determining that the gas pocket is approaching the inlet, operation of the ESP system is interrupted and one or more vent ports defined between the annulus and an interior of the tubing string are opened to vent the free gas from the annulus to the interior of the tubing string while operation of the ESP system is interrupted.

20 Claims, 2 Drawing Sheets

HYDRAULIC SLIDING SLEEVE FOR ELECTRIC SUBMERSIBLE PUMP APPLICATIONS

FIELD OF THE DISCLOSURE

The present disclosure relates generally to electric submersible pump (ESP) systems and, more particularly, to venting free gas in wellbore systems including a submersible pump disposed below a packer or another annulus ceiling.

BACKGROUND OF THE DISCLOSURE

In oilfield production operations, valuable hydrocarbon fluids are drawn from subterranean locations to surface facilities or other collection locations through a wellbore. If these fluids do not readily flow to collection locations under existing natural forces, an electric submersible pump (ESP) system may be installed in the wellbore to artificially lift (pump) the fluid toward the surface. In many instances, the formation of free gas at the intake of the ESP can severely damage the submersible pump or degrade its performance. In wellbore environments with a high gas to oil ratio (GOR), a gas lockup condition can result in which the submersible pump is unable to deliver enough pressure to maintain continuous pumping.

Free gas around an ESP system generally travels to a tubing-casing annulus (TCA) ceiling, which may be a wellhead or a packer. When a packer is used above the submersible pump, free gas often accumulates below the packer and eventually creates a gas pocket that gradually builds (accumulates) until reaching the intake of the submersible pump. An accumulation of free gas at the intake may trigger the gas lockup condition. Attempts have been made to address the accumulation of free gas below the packer, but these attempts have met with limited success. Without sufficient removal of the accumulated gas, the submersible pump can be exposed to free gas which reduces pumping efficiency and increases the possibility of reaching the gas lockup condition.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method of producing a wellbore fluid from a wellbore is disclosed and includes operating an electrical submersible pump (ESP) system in a wellbore to draw the wellbore fluid into a tubing string arranged within the wellbore and propel the wellbore fluid toward a surface location, determining that a volume of a gas pocket containing free gas is approaching an inlet of the ESP system, the gas pocket being provided in an annulus around the tubing string, and interrupting operation of the ESP system in response to a determination that the volume of the gas pocket is approaching the inlet. The method may further include opening one or more vent ports defined in the tubing string above the ESP system to vent the free gas from the annulus to an interior of the tubing string while operation of the ESP system is interrupted.

According to another embodiment consistent with the present disclosure, a system for producing a wellbore fluid from a wellbore is disclosed and includes an electric submersible pump (ESP) system disposed in the wellbore and operable to draw the wellbore fluid into a tubing string arranged within the wellbore and pump the wellbore fluid toward a surface location within the tubing string, a controller operable to determine that a volume of a gas pocket of free gas is approaching an inlet of the ESP system, the gas pocket being provided in an annulus around the tubing string, and one or more vent ports defined between the annulus and an interior of the tubing string. A closure member may be selectively operable to move between a closed position, where the closure member occludes one or more vent ports defined in the tubing string, and an open position, where the closure member is moved to expose the one or more vent ports. The closure member may be moved to the open position in response to the gas pocket approaching the inlet, and the free gas may be vented from the annulus to an interior of the tubing string when the closure member is in the open position.

According to another embodiment consistent with the present disclosure, a controller for an electric submersible pump (ESP) system in a wellbore is disclosed and may include an input operable to receive variables determinative of a volume of a gas pocket of free gas approaching an inlet to the ESP system, a logic module operable to determine from the variables that the volume of the gas pocket is approaching the inlet, and an output operable to perform at least one of the functions in the group consisting of providing an alert to an operator that the volume of the gas pocket is approaching the inlet, interrupting operation of the ESP in response to determining that the volume of the gas pocket is approaching the inlet and providing instructions to an actuator to open one or more vent ports in response to determining that the volume of the gas pocket is approaching the inlet.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
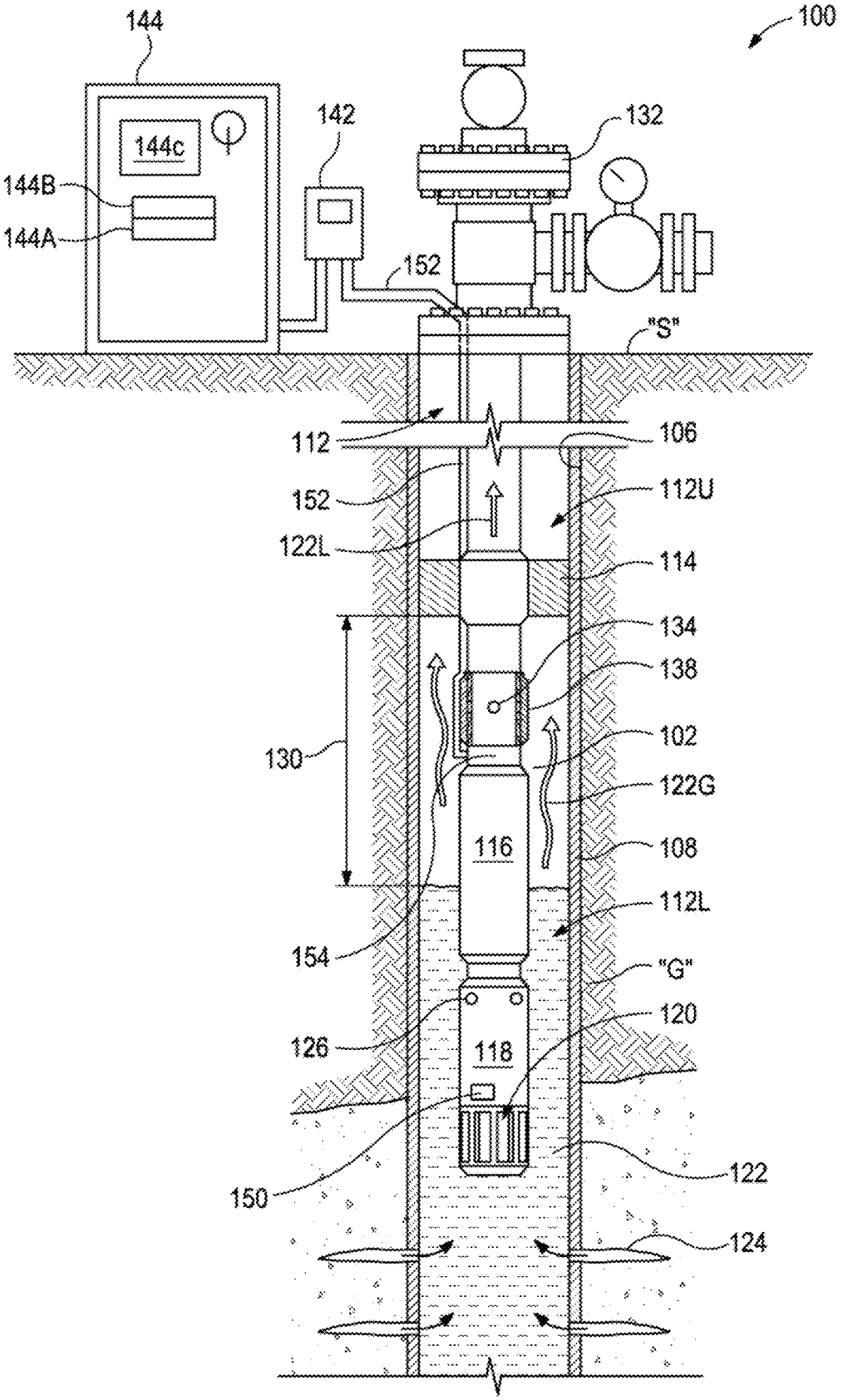
FIG. 1 is a partial cross-sectional view of a wellbore system including an ESP system deployed below a packer and a sliding sleeve operable to vent free gas into a production tubing string.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a wellbore system and method for venting free gas that may accumulate below a packer and above a submersible pump. The system may include a hydraulically activated sliding sleeve valve defined in a production tubing string that may be opened selectively and periodically to vent the free gas into the production tubing string.

FIG. 1 is a schematic view of a wellbore system 100 that includes an ESP system 102 in accordance with example embodiments of the present disclosure. The ESP system 102 is disposed in a wellbore 106 extending from a surface location "S" and traversing a geologic formation "G." In the illustrated example, the wellbore 106 is substantially vertical. In other embodiments, however, aspects of the disclosure may be practiced in a wide variety of vertical, directional, deviated, slanted and/or horizontal portions therein, and may extend along any trajectory through the geologic formation "G." As illustrated in FIG. 1, the wellbore 106 is lined with a casing string 108, however, in other embodiments, the wellbore 106 may not be cased.

In the example embodiment illustrated, the ESP system 102 is deployed on a tubing string 110 such as a production tubing or coiled tubing. An annulus 112 is defined radially between the tubing string 110 and the surrounding structure, e.g., the casing string 108. The tubing string 110 extends through an isolation device, such as packer 114, which forms a seal with the tubing string 110 and the surrounding casing string 108. The packer 114 fluidly isolates a lower portion of the annulus 112L surrounding the ESP system 102 from an upper portion 112U above the packer 114.

The ESP system 102 includes a submersible pump 116 and a gas handler 118 operatively coupled at a lower end of the tubing string 110. The submersible pump 116 may be a multi-stage centrifugal pump that operates by transferring pressure to the wellbore fluids 122 to draw the wellbore fluids 122 into the tubing string 110 and propel the wellbore fluids 122 to the surface location "S" at a desired pumping rate. The submersible pump 116 may have any suitable size or construction based on the characteristics, e.g., wellbore size, desired pumping rate, etc., of the wellbore operation for which the submersible pump 116 is employed. The submersible pump 116 may operate to transfer pressure to the wellbore fluids 122 by employing a motor (not shown) operably coupled to one or more impellers (not shown) and diffusers (not shown) as generally recognized in the art.

The gas handler 118 includes an inlet 120 submerged in the wellbore fluid 122, which may include a gas component 122G and a liquid component 122L. The wellbore fluid 122 may include hydrocarbons or other resources that flow into the wellbore 106 through perforations 124 formed through the casing string 108 and into the geologic formation "G." Where the wellbore fluid 122 has a relatively high gas-to-liquid ratio, e.g. 20% or more, the gas component 122G can interfere with the pumping efficiency of the submersible pump 116.

The gas handler 118 may generally operate to separate the liquid component 122L of the wellbore fluid 122 from the gas component 122G. Various types of gas handlers 118 may be employed in the ESP system 102. For example, a static gas separator may slow the flow of wellbore fluid to permit gravity to naturally separate the liquid and gas components 122L,G. Dynamic gas separators may employ a centrifuge to radially separate the liquid and gas components. The liquid component 122L□ may be delivered to the submersible pump 116, which may pump the liquid component 122L to the surface location "S" through the tubing string 110. It should be appreciated that the liquid component 122L pumped to the surface location may still include some gas entrained therein. The gas component 122G that is separated by the gas handler 118 may be exhausted (discharged) into the annulus 112 through exhaust ports 126 defined in the gas handler 118. The gas component 122G exhausted through the exhaust ports 126 may bubble up through the wellbore fluid 122 to form a gas pocket 130 in the annulus 112 below the packer 114.

In some embodiments, the gas handler 118 may be excluded without departing from the scope of the disclosure. In such embodiments, some separation of the liquid 122L and gas components 122G may occur as the wellbore fluid 122 enters an inlet (not shown) to the submersible pump 116, and the gas component 122G may be discharged to accumulate in the gas pocket 130.

The gas pocket 130 may be defined generally between the packer 114 and an upper surface of the wellbore fluid 122. In other embodiments, the gas pocket 130 may be defined between a different ceiling and the upper surface of the wellbore fluid 122. For example, where a packer 114 is not provided, the gas pocket 130 may be defined between a wellhead 132 and the surface of the wellbore fluid 122. Accordingly, the upper limit or "ceiling" of the gas pocket 130 may be defined by a variety of wellbore structures or devices. As wellbore fluid 122 is produced, the gas component 122G may gradually and progressively accumulate in the gas pocket 130, causing the volume of the gas pocket 130 to increase and otherwise grow downward toward the inlet 120 of the ESP system 102. If the gas pocket 130 grows to reach the inlet 120, the submersible pump 116 risks undergoing a gas lockup condition, which can adversely affect pump performance.

To release the gas component 122G from the gas pocket 130, one or more vent ports 134 is provided in the tubing string 110. A sliding sleeve 138 is provided around the tubing string to selectively close and open the vent ports 134. In other embodiments, the sliding sleeve 138 may be replaced other types of valve closure members capable of occluding and exposing the vent port(s) 134, without departing from the scope of the disclosure. In the closed position, as illustrated in FIG. 1, the sliding sleeve 138 covers (occludes) the vent ports 134 to permit production of the wellbore fluid 122 through the tubing string 110 to the wellhead 132, while simultaneously preventing the gas within the gas pocket 130 from migrating into the tubing string 110 via the vent port(s) 134. Moving the sliding sleeve 138 to an open position, as schematically depicted in FIG. 2B, will permit the gas accumulated in the gas pocket 130 to vent into the tubing string 110 via the vent port(s) 134.

To operate the sliding sleeve 138, a hydraulic pump 142 and an associated controller 144 are provided at the surface location "S" in the embodiment illustrated in FIG. 1. In other embodiments, the hydraulic pump 142 and/or the controller 144 may be provided at a downhole location without departing from the scope of the disclosure. The controller 144 is operably coupled to the hydraulic pump 144 to provide instructions (command signals) thereto. In some embodiments, the controller 144 may also be communicatively coupled to a sensor 150 to receive data therefrom. The sensor 150 may be disposed in the wellbore 106 adjacent the inlet 120 and may provide data regarding the composition or conditions of the wellbore fluid 122. In some embodiments, the controller 144 may be a computer-based system that may include a processor, a memory storage device, and programs and instructions, accessible to the processor for executing the instructions utilizing the data stored in the memory storage device. In other embodiments, the controller 144 may include manual controls that may be manipulated by an operator to control any of the procedures and equipment described herein.

In some embodiments, the controller 144 may be operable to provide an alert to an operator that the gas pocket 130 may be approaching the inlet 120. The controller 144 may determine that the gas pocket 130 is approaching the inlet based on physical and operational characteristics of the wellbore system such as an available volume in the annulus 112, a gas to liquid ratio of a wellbore fluid 122 and a production rate of the wellbore fluid 122. Additionally or alternatively, the controller 144 may determine that the gas pocket 130 may be approaching the inlet 120 based on data provided by the sensor 150. In some example embodiments, the controller 144 may be operably coupled to the submersible pump 116 to interrupt (stop, cease, etc.) operation of the submersible pump 116 in the event the controller 144 determines that the gas pocket 130 is approaching the inlet 120.

As illustrated, the controller 144 includes an input 144A operable to receive variables determinative of the gas pocket 130 approaching the inlet 120. The variables may include a gas to liquid ratio of a wellbore fluid, a production rate of the wellbore fluid and an annulus volume between a ceiling and the inlet 120 to the ESP system 102. The variables may also include a characteristic of the wellbore fluid 122 provided by the sensor 150. The controller includes a logic module 144B operable to determine from the variables that the gas pocket 130 is approaching the inlet 120, and further includes an output 144C operable to perform at least one function in response to determining that the gas pocket 130 is approaching the inlet 120. These functions may include providing an alert to an operator. For example, the output includes a display operable to provide a visual indication that the gas pocket 130 is approaching the inlet 120. The functions performed by the output 144*c* may also include interrupting (stopping, ceasing, etc.) operation of the ESP system 102 and providing instructions to an actuator, e.g., hydraulic pump 142 to open the vent ports 134.

A hydraulic line 152 extends from the hydraulic pump 144 into the wellbore 106 through the wellhead 132. The hydraulic line 144 extends to an actuator 154, which may selectively drive the sliding sleeve 138 between the closed position, where the sliding sleeve 138 obstructs fluid flow through the vent ports 134, and an open position (FIG. 2B), where the sliding sleeve 138 permits fluid flow through the vent ports 134.

Figure 2A:
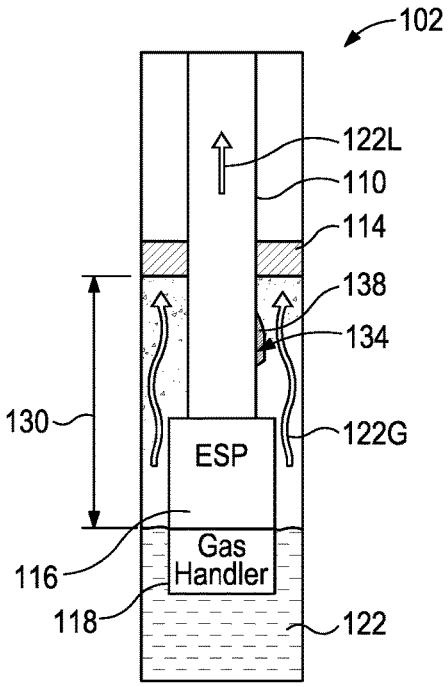
FIGS. 2A and 2B are schematic views of the sliding sleeve of FIG. 1 in open and closed configurations, respectively.
Figure 2B:
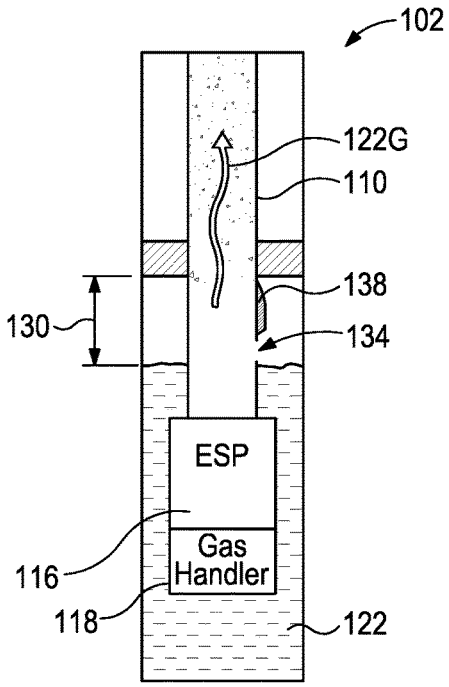

Referring to FIGS. 2A and 2B, the wellbore ESP system 102 is illustrated schematically with the sliding sleeve 138 in closed and open positions, respectively. As illustrated in FIG. 2A, the sliding sleeve 138 is in a closed position and otherwise occluding the port(s) 134. When the sliding sleeve 138 covers the vent ports 134, the liquid component 122L of the wellbore fluid 122 may be produced through production tubing 110. The gas component 122G and any other free gas around the ESP system 102 accumulates beneath the packer 114 to form gas pocket 130. The gas pocket 130 is illustrated as approaching the gas handler 118.

Before the gas pocket 130 reaches the inlet 120 (FIG. 1) of the gas handler 118, the sliding sleeve 138 may be moved to the open position, as illustrated in FIG. 2B. Upon moving to the open position, the vent ports 134 are uncovered (exposed), which permits the gas component 122G and any other free gas in the gas pocket 130 to be vented through the production tubing 110. As the free gas within the gas pocket 130 is vented, the volume of the gas pocket 130 is reduced and no longer approaches the gas handler 118 where the free gas may enter the ESP 102 and induce the gas lockup condition. Rather, the wellbore fluid 122 may progressively fill the void of the decreasing volume of the gas pocket 130.

Figure 3:
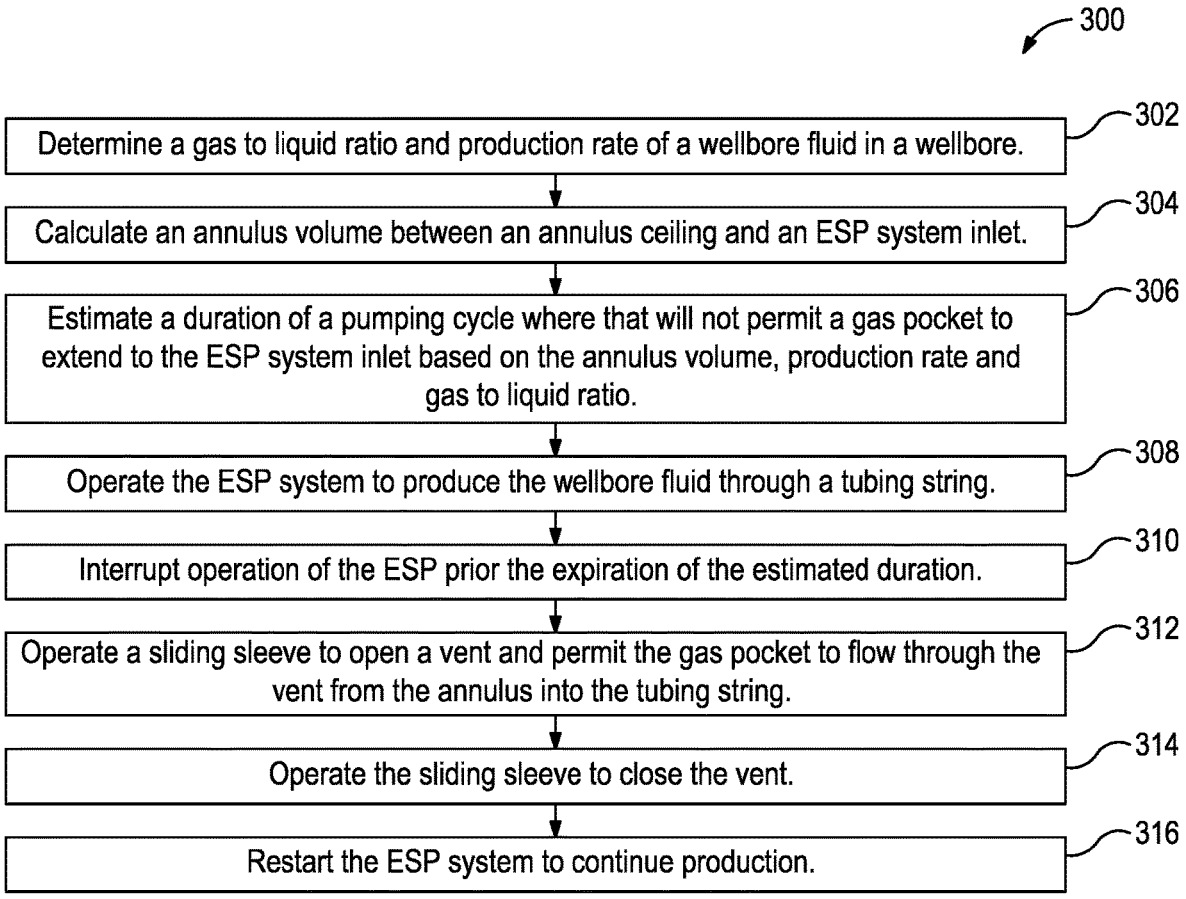
FIG. 3 is a flowchart illustrating a procedure for venting free gas in a wellbore with the sliding sleeve.

Referring to FIG. 3, and with reference to FIGS. 1 through 2B, an example procedure 300 is illustrated for venting free gas from the wellbore 106. Initially, at step 302, a gas to liquid ratio of a wellbore fluid 122 and a production rate of the wellbore fluid is determined. Estimates for the gas to liquid ratio and the production rate may be estimated empirically or experimentally. A rate of separation of the gas component 122G may be calculated from these estimates. Next, at step 304, an annulus volume is calculated between a tubing-casing-annulus (TCA) ceiling and an inlet 120 of ESP system 102 installed in the wellbore 106. The annulus volume represents an available space for free gas to accumulate before the gas pocket 130 approaches the inlet 120. At step 306, the duration of a production pumping cycle may be estimated from the annulus volume, production rate and gas to liquid ratio, which will not permit the gas pocket 130 to extend to the inlet 120. The duration estimated in step 306 represents a threshold duration that the submersible pump 116 should be operated before venting the free gas.

At step 308, the ESP system 102 is operated to pump the wellbore fluid 122 to the surface location "S." As the operation of the ESP system 102 continues, and as gas starts accumulating within the wellbore 106, the volume of the gas pocket 130 may progressively expand downwardly from the packer 114 and toward the inlet 120 of the gas handler 118. At step 310, the operation of the ESP system 102 may be interrupted before the expiration of the duration estimated in step 306. Moreover, in some embodiments, the operation of the ESP system 102 may be interrupted before the gas pocket 130 reaches the inlet 120, which could result in a gas lockup condition for the ESP system 102.

At step 312, the sliding sleeve 138 is moved (actuated) to the open position (see FIG. 2B) where the vent ports 134 are uncovered. An operator may manipulate controls of the controller 144 to move the sliding sleeve 138, for example, in response to an alert provided by the controller 144 that the gas pocket 130 may be approaching the inlet 120. In other embodiments, however, the controller 144 may be programmed to trigger actuation of the sliding sleeve 138 upon determining that the gas pocket 130 is within a predetermined distance of the inlet 120. The controller 144 may instruct the hydraulic pump 142 to operate to apply a suitable hydraulic pressure on the sliding sleeve 138 to cause the sliding sleeve 138 to move to the open position. Moving the sliding sleeve 138 will permit the gas component 122G of the wellbore fluid 122 and any other free gas accumulating beneath the packer 114 to be vented through the production tubing 110. The volume of the gas pocket 130 is thereby reduced, and a risk of free gas entering the ESP 102 and inducing the gas lockup condition is mitigated or entirely prevented.

Once the free gas is vented, the procedure 300 proceeds to step 314 where the sliding sleeve 138 is moved back to the closed position (see FIG. 2A) where the vent ports 134 are once again covered (occluded). The operator may manipulate controls of the controller 144 to cause the hydraulic pump 142 to operate to apply a suitable hydraulic pressure on the sliding sleeve to 138 to move the move the sliding sleeve 138 to the closed position. Alternatively or additionally, the controller may instruct the hydraulic pump to operate in response to determining that the gas pocket 130 has been sufficiently reduced. Moving the sliding sleeve 138 to the closed position prevents the loss of any of the liquid component 122L or other production fluids through the vent ports 134.

The procedure 300 then proceeds to step 316 where the submersible pump 116 and any other components of the ESP 102 may be restarted. Production of the liquid component 122L may be continued with a reduced risk of the gas lockup condition occurring.

The procedure 300 has been described as one example operation in which the sliding sleeve 138 may be used to vent free gas through the production tubing 110. In other embodiments, the sliding sleeve 138 may be operated in response to a gas lockup condition being detected. The free gas may be vented as part of a troubleshooting and restarting procedure for the ESP system 102. In some other embodiments, it may be determined that the gas pocket 130 is approaching the inlet 120 by detecting a characteristic of the wellbore fluid 122 with the sensor 150 that is indicative of the approaching gas pocket 130. For example, the sensor 150 may detect a gas content of the wellbore fluid 122 that is above a predetermined threshold. In other embodiments, the free gas may be vented, even if the gas pocket 130 is not approaching the inlet 120, for example when the ESP is not operating for maintenance or any other interruption in production.

Embodiments disclosed herein include:

A. A method of producing a wellbore fluid from a wellbore is disclosed and includes operating an electrical submersible pump (ESP) system in a wellbore to draw the wellbore fluid into a tubing string arranged within the wellbore and propel the wellbore fluid toward a surface location, determining that a volume of a gas pocket containing free gas is approaching an inlet of the ESP system, the gas pocket being provided in an annulus around the tubing string, and interrupting operation of the ESP system in response to a determination that the volume of the gas pocket is approaching the inlet. The method may further include opening one or more vent ports defined in the tubing string above the ESP system to vent the free gas from the annulus to an interior of the tubing string while operation of the ESP system is interrupted.

B. A system for producing a wellbore fluid from a wellbore is disclosed and includes an electric submersible pump (ESP) system disposed in the wellbore and operable to draw the wellbore fluid into a tubing string arranged within the wellbore and pump the wellbore fluid toward a surface location within the tubing string, a controller operable to determine that a volume of a gas pocket of free gas is approaching an inlet of the ESP system, the gas pocket being provided in an annulus around the tubing string, and one or more vent ports defined between the annulus and an interior of the tubing string. A closure member may be selectively operable to move between a closed position, where the closure member occludes one or more vent ports defined in the tubing string, and an open position, where the closure member is moved to expose the one or more vent ports. The closure member may be moved to the open position in response to the gas pocket approaching the inlet, and the free gas may be vented from the annulus to an interior of the tubing string when the closure member is in the open position.

C. A controller for an electric submersible pump (ESP) system in a wellbore is disclosed and may include an input operable to receive variables determinative of a volume of a gas pocket of free gas approaching an inlet to the ESP system, a logic module operable to determine from the variables that the volume of the gas pocket is approaching the inlet, and an output operable to perform at least one of the functions in the group consisting of providing an alert to an operator that the volume of the gas pocket is approaching the inlet, interrupting operation of the ESP in response to determining that the volume of the gas pocket is approaching the inlet and providing instructions to an actuator to open one or more vent ports in response to determining that the volume of the gas pocket is approaching the inlet.

Each of embodiments A, B, and C may have one or more of the following additional elements in any combination: Element 1: wherein determining that the volume of the gas pocket is approaching the inlet includes determining that a threshold quantity of a gas component of the wellbore fluid has been separated from a liquid component of the wellbore fluid. Element 2: further comprising separating the gas component from the liquid component with a gas handler in the wellbore. Element 3: wherein determining that the volume of the gas pocket is approaching the inlet includes detecting a characteristic of the wellbore fluid indicative of the gas pocket approaching with a sensor arranged adjacent the inlet of the ESP system. Element 4: further comprising providing an alert to an operator in response to determining that the volume of the gas pocket is approaching the inlet. Element 5: wherein opening the one or more vent ports includes longitudinally displacing a sliding sleeve disposed around the tubing string. Element 6: wherein displacing the sliding sleeve includes applying a hydraulic pressure to the sliding sleeve with a hydraulic pump. Element 7: wherein venting the free gas from the annulus includes bypassing a packer installed in the annulus. Element 8: further comprising closing the one or more vent ports subsequent to venting the free gas, and restarting the ESP system to continue producing the wellbore fluid.

Element 9: wherein the ESP system includes a gas handler that provides the inlet and is operable to separate a gas component from a liquid component of the wellbore fluid, and wherein the gas component is discharged as a portion of the free gas accumulating within the gas pocket. Element 10: wherein the ESP system further includes a submersible pump coupled to the gas handler to receive the liquid component of the wellbore fluid from the gas handler. Element 11: further comprising a sensor adjacent the inlet and operable to detect a characteristic of the wellbore fluid indicative of the volume of the gas pocket approaching the inlet. Element 12: wherein the closure member comprises a sliding sleeve disposed around or within the tubing string. Element 13: further comprising a hydraulic pump operably coupled to the sliding sleeve to apply a hydraulic pressure to the sliding sleeve to longitudinally move the sliding sleeve and thereby transition the closure member between the closed and open positions. Element 14: further comprising a packer installed around the tubing string in the annulus and defining a ceiling for the gas pocket. Element 15: wherein the packer is installed above the one or more vent ports.

Element 16: wherein the output includes a display operable to provide a visual indication that the volume of the gas pocket is approaching the inlet. Element 17: wherein the logic module is operable to determine that the volume of the gas pocket is approaching the inlet from the variables including a gas to liquid ratio of a wellbore fluid, a production rate of the wellbore fluid and an annulus volume between a ceiling and the inlet to the ESP system.

By way of non-limiting example, exemplary combinations applicable to A, B, and C include: Element 1 with Element 2; Element 5 with Element 6; Element 9 with Element 10; Element 12 with Element 13; and Element 14 with Element 15.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method of producing a wellbore fluid from a wellbore, the method comprising:

operating an electrical submersible pump (ESP) system in the wellbore to draw the wellbore fluid into a tubing string arranged within the wellbore and propel the wellbore fluid toward a surface location;

determining that a volume of a gas pocket containing free gas is approaching an inlet of the ESP system, the gas pocket being provided in an annulus around the tubing string;

interrupting operation of the ESP system in response to a determination that the volume of the gas pocket is approaching the inlet;

activating a hydraulic pump to apply a hydraulic pressure to a sliding sleeve disposed within the gas pocket and around the tubing string; and opening one or more vent ports defined in the tubing string above the ESP system by longitudinally displacing the sliding sleeve to vent the free gas from the gas pocket directly to an interior of the tubing string while operation of the ESP system is interrupted.

2. The method of claim 1, wherein determining that the volume of the gas pocket is approaching the inlet includes determining that a threshold quantity of a gas component of the wellbore fluid has been separated from a liquid component of the wellbore fluid.

3. The method of claim 2, further comprising separating the gas component from the liquid component with a gas handler in the wellbore.

4. The method of claim 1, wherein determining that the volume of the gas pocket is approaching the inlet includes detecting a characteristic of the wellbore fluid indicative of the gas pocket approaching with a sensor arranged adjacent the inlet of the ESP system.

5. The method of claim 1, further comprising providing an alert to an operator in response to determining that the volume of the gas pocket is approaching the inlet.

6. The method of claim 1, wherein venting the free gas from the annulus includes bypassing a packer installed in the annulus.

7. The method of claim 1, further comprising:

closing the one or more vent ports subsequent to venting the free gas; and restarting the ESP system to continue producing the wellbore fluid.

8. The method of claim 1, further comprising estimating a duration of a production cycle that will not permit the gas pocket to extend to the inlet.

9. The method of claim 8, wherein the duration is estimated based on an annulus volume, production rate and a gas to liquid ratio.

10. The method of claim 9, wherein interrupting operation of the ESP system is performed prior to an expiration of the duration estimated.

11. A system for producing a wellbore fluid from a wellbore, the system comprising:

an electric submersible pump (ESP) system disposed in the wellbore and operable to draw the wellbore fluid into a tubing string arranged within the wellbore and pump the wellbore fluid toward a surface location within the tubing string;

a controller operable to determine that a volume of a gas pocket of free gas is approaching an inlet of the ESP system, the gas pocket being provided in an annulus around the tubing string;

one or more vent ports defined between the annulus and an interior of the tubing string;

a sliding sleeve disposed within the gas pocket and selectively operable to move between a closed position, where the sliding sleeve occludes the one or more vent ports defined in the tubing string, and an open position, where the sliding sleeve is moved to expose the one or more vent ports to establish a direct flowpath between the gas pocket and the interior of the tubing string; and a hydraulic pump operably coupled to the sliding sleeve to apply a hydraulic pressure to the sliding sleeve to longitudinally move the sliding sleeve and thereby transition the sliding sleeve between the closed and open positions, wherein the sliding sleeve is moved to the open position in response to the gas pocket approaching the inlet, and wherein the free gas is vented from the annulus to the interior of the tubing string when the closure member is in the open position.

12. The system of claim 11, wherein the ESP system includes a gas handler that provides the inlet and is operable to separate a gas component from a liquid component of the wellbore fluid, and wherein the gas component is discharged as a portion of the free gas accumulating within the gas pocket.

13. The system of claim 12, wherein the ESP system further includes a submersible pump coupled to the gas handler to receive the liquid component of the wellbore fluid from the gas handler.

14. The system of claim 11, further comprising a sensor adjacent the inlet and operable to detect a characteristic of the wellbore fluid indicative of the volume of the gas pocket approaching the inlet.

15. The system of claim 11, further comprising a packer installed around the tubing string in the annulus and defining a ceiling for the gas pocket.

16. The system of claim 15, wherein the packer is installed above the one or more vent ports.

17. An electric submersible pump (ESP) system in a wellbore, the system comprising:

a tubing string arranged within the wellbore;

an ESP disposed within the wellbore and operable to pump wellbore fluid toward a surface location within the tubing string;

a sliding sleeve disposed around an exterior of the tubing string and selectively operable to move between a closed position, where the sliding sleeve occludes one or more vent ports defined in the tubing string, and an open position, where the sliding sleeve is moved to expose the one or more vent ports to establish a direct flowpath between the exterior of the tubing string and the interior of the tubing string;

a hydraulic pump operably coupled to the sliding sleeve to apply a hydraulic pressure to the sliding sleeve to longitudinally move the sliding sleeve and thereby transition the sliding sleeve between the closed and open positions;

an input operable to receive variables determinative of a volume of a gas pocket of free gas approaching an inlet to the ESP;

a logic module operable to determine from the variables that the volume of the gas pocket is approaching the inlet; and an output operable to perform at least one of the functions in the group consisting of providing an alert to an operator that the volume of the gas pocket is approaching the inlet, interrupting operation of the ESP in response to determining that the volume of the gas pocket is approaching the inlet and providing instructions to the hydraulic pump to open one or more vent ports in response to determining that the volume of the gas pocket is approaching the inlet.

18. The system of claim 17, wherein the output includes a display operable to provide a visual indication that the volume of the gas pocket is approaching the inlet.

19. The system of claim 17, wherein the logic module is operable to determine that the volume of the gas pocket is approaching the inlet from the variables including a gas to liquid ratio of a wellbore fluid, a production rate of the wellbore fluid and an annulus volume between a ceiling and the inlet to the ESP system.

20. The method of claim 17, wherein the logic module is operable to determine from the variables a duration of a production cycle that will not permit the gas pocket to extend to the inlet, and wherein the output is operable to interrupt operation of the ESP prior to an expiration of the duration estimated.

* * * * *